US009032861B2

(12) United States Patent
Goenechea et al.

(10) Patent No.: US 9,032,861 B2
(45) Date of Patent: May 19, 2015

(54) ARRANGEMENT FOR PROVIDING A VARIABLE THROTTLE CROSS-SECTION FOR A FLUID FLOW

(75) Inventors: Eneko Goenechea, Waedenswil (CH); Josef Zürcher, Neuheim (CH); Silvan Thuerlemann, Unteraegeri (CH)

(73) Assignee: Bucher Hydraulics AG, Neuheim (CH)

( * ) Notice: Subject to any disclaimer, the term of this patent is extended or adjusted under 35 U.S.C. 154(b) by 701 days.

(21) Appl. No.: 13/382,495

(22) PCT Filed: Jul. 6, 2009

(86) PCT No.: PCT/CH2009/000238

§ 371 (c)(1),
(2), (4) Date: Jan. 5, 2012

(87) PCT Pub. No.: WO2011/003210

PCT Pub. Date: Jan. 13, 2011

(65) Prior Publication Data

US 2012/0125190 A1 May 24, 2012

(51) Int. Cl.

| | |
|---|---|
| ***F15B 1/24*** | (2006.01) |
| ***F15B 13/042*** | (2006.01) |
| ***B66B 1/24*** | (2006.01) |
| ***F15B 11/042*** | (2006.01) |
| ***F15B 11/044*** | (2006.01) |

(52) U.S. Cl.

CPC ..... *F15B 13/0426* (2013.01); *B66B 1/24* (2013.01); *F15B 11/042* (2013.01); *F15B 11/044* (2013.01)

(58) Field of Classification Search

CPC ..... F15B 13/01; F15B 13/042; F15B 13/044; F15B 13/0426; B66B 1/24

USPC ..... 91/446, 447, 358 R

See application file for complete search history.

(56) References Cited

U.S. PATENT DOCUMENTS

| | | | | |
|---|---|---|---|---|
| 3,981,478 | A * | 9/1976 | Lundsgart | 251/29 |
| 4,202,174 | A * | 5/1980 | Grigorenko et al. | 60/413 |
| 4,353,286 | A * | 10/1982 | Wetter | 91/5 |
| 4,955,283 | A | 9/1990 | Hidaka et al. | |
| 5,752,546 | A * | 5/1998 | Yamashita | 137/540 |
| 5,937,645 | A * | 8/1999 | Hamamoto | 60/422 |
| 7,036,421 | B2 * | 5/2006 | Joergensen | 91/32 |

FOREIGN PATENT DOCUMENTS

| | | |
|---|---|---|
| EP | 0 023 591 | 2/1981 |
| JP | 2000/337304 | 12/2000 |

* cited by examiner

*Primary Examiner* — Thomas E Lazo

(74) *Attorney, Agent, or Firm* — Cozen O'Connor

(57) ABSTRACT

An arrangement for providing a throttle cross-section for a fluid flow. The throttle cross-section can be varied depending on a pressure difference present across the throttle cross-section. The arrangement is designed such that the polarity of the pressure difference, by which the throttle cross-section can be varied and/or changed. It is thereby possible to use the arrangement for fluid flows that alternate in the flow direction thereof.

16 Claims, 3 Drawing Sheets

ARRANGEMENT FOR PROVIDING A VARIABLE THROTTLE CROSS-SECTION FOR A FLUID FLOW

CROSS REFERENCE TO RELATED APPLICATION

This is a U.S. national stage of application No. PCT/CH2009/000238, filed on 6 Jul. 2009.

BACKGROUND

1. Field of the Invention

The invention is related to an arrangement for providing a variable throttle cross-section for a fluid flow, a lift control valve with the arrangement, a hydraulic lift installation with the lift control valve as well as a method for operating the lift installation according to the preambles of the independent claims.

2. Prior Art

Various arrangements for providing variable throttle cross-sections for fluid flows conducted there through are available today for hydraulic and pneumatic installations, namely for regulating pressures and/or volumes as well as also for their measurement. In these cases the variation of the throttle cross-section is done either by external regulating intervention by mechanic, hydraulic, pneumatic or electric regulatory actuators, i.e. in case of control valves, or by the pressure, a pressure difference and/or a flow force of the fluid conducted inside the arrangement, like for example in case of pressure limiting valves or non-return valves. The latter arrangements have the advantage that high operation reliability is reached as a result of the relatively simple hydraulic/pneumatic coupling and the independence from auxiliary energy. It is however disadvantageous that these arrangements are typically only usable in one direction of flow. This is a problem for devices in case in which fluid flows with changing flow direction occur, depending on the operation situation, like in case of lift control valves for hydraulic lift installations, this being solved today by using multiple such arrangements and a complex switching thereof. This imposes however a considerable financial and technical effort and additionally leads to not negligible maintenance costs.

SUMMARY OF THE INVENTION

Therefore it is a task to provide an arrangement for providing a variable throttle cross-section for a fluid flow in case of which the throttle cross-section can be varied by the pressure, a pressure difference, and/or a flow force of the fluid conducted inside the arrangement and which does not have or at least partly avoids the disadvantages of the prior art.

According to one embodiment, the arrangement for providing a variable throttle cross-section for a fluid flow, particularly for a liquid flow, i.e. a flow of hydraulic oil, comprises a throttle arrangement and an actuation arrangement. The throttle arrangement forms a throttle cross-section that can be varied by a motion of a throttle body. The actuation arrangement has an actuation element that is movable inside a casing and being coupled to the throttle body of the throttle arrangement in order to change the throttle cross-section of the throttle arrangement by changing the relative position of the actuation element inside the casing. Preferably, the coupling between the throttle body and the actuation element is done hydraulically or mechanically, advantageously by a common forming of the throttle body and the actuation element, particularly in one piece.

Thereby, the arrangement is formed such that the actuation element is permanently acted upon by a spring force (first spring force), or can be acted upon by such a spring force, i.e. by supplying auxiliary energy. The spring force acts upon the actuation element in a first direction, in which the latter is movable inside the casing. For this, it is for example conceivable that a spring element or a compressible medium under pressure exerts a pressure force, in a suitable direction, directly onto the actuation element and/or onto the throttle body coupled with the actuation element. The spring force causes that the actuation element is positioned in a base position in the casing in the absence of at least equal forces acting upon the actuation element in a second direction which is opposed to the first direction.

Further, the arrangement is formed in such a way that the actuation element can be acted upon with a second and a third force acting both in the second direction according to the claim, thus opposite to the spring force, as a result of fluid pressures in a first fluid chamber of the arrangement which is permanently fluid-connected to a first side of the throttle cross-section or fluid-connectable to this first side, and in a second fluid chamber of the arrangement which is permanently fluid-connected to the other, second side of the throttle cross-section or fluid-connectable with this second side.

Also, the arrangement is formed such that as a result of a fluid pressure in a third fluid chamber of the arrangement the actuation element can be acted upon with a fourth force acting in the first direction, thus with a fourth force acting in the direction of the spring force.

This forming results in that the actuation element, in case no further forces act upon it in the first or the second, and a summed up force results from the second, the third and the fourth force, acting in the second direction which is opposed to the spring force, and which is higher than the spring force acting in the base position, is moved away from the base position until a balance of forces between the spring force acting upon the actuation element in the corresponding relative position and the force resulting from the second, the third and the fourth force in the direction opposed to the spring force is reached or a maximum motion position is reached.

Further, the arrangement according to one embodiment of the invention comprises a switching arrangement, for example a 3/2 way valve that can be actuated hydraulically, by which optionally either the first and the third fluid chamber of the arrangement or the second and the third fluid chamber of the arrangement are fluid-connectable. If the first side of the throttle cross-section is fluid-connected with the first fluid chamber and the second side of the throttle cross-section is fluid-connected with the second fluid chamber, the actuation element can be moved out of the base position, in order to open or enlarge respectively the throttle cross-section, depending on the switch state, meaning depending if the third fluid chamber is connected with the first or with the second fluid chamber, either when a positive or when a negative pressure difference occurs between the first side and the second side of the throttle gap.

An arrangement for providing a throttle cross-section for a fluid flow is provided, in case of which the throttle cross-section is variable or can be opened respectively depending on a pressure difference across it and in case of which the polarity of the pressure difference, by which the throttle cross-section is variable or can be opened respectively, can be switched. By this it is possible to use the arrangement according to one embodiment of the invention for devices with fluid flows which change with respect to their flow direction.

In a preferred embodiment the arrangement is formed such that the throttle cross-section is entirely closed when the actuation element is arranged in the base position, thus both sides of the throttle cross-section are separated from each other, such that in this position the first fluid chamber is separated from the second fluid chamber. This separation preferably takes place such that a leakage-free separation is present in case of correct pressures and the planned fluids. This can i.e. be achieved in such a way that the throttle arrangement is formed as a seat valve. Such embodiments of the arrangement according to the invention may i.e. be used as non-return valves, this being a preferred usage of them.

In a preferred embodiment the arrangement has one or more elements for determining the opening of the throttle cross-section of the throttle arrangement, the relative position of the actuation element in the casing and/or the relative position of the throttle body of the throttle arrangement, thus elements with which a variable representing the corresponding throttle cross-section can be determined. Preferably, these elements comprise sensors by which the relative positions of the actuation element and/or the throttle body can be converted in electric signals, such that an electronic evaluation of the determined measurement values is possible. Such embodiments of the arrangement according to the invention may be used i.e. as flow meters with switchable flow direction, this being a further preferred usage of the arrangement according to the invention. Particularly in case of non-compressible fluids like i.e. water or in case of only very little compressible fluids like i.e. mineral oil there is the advantage that, in case of a known characteristic of the arrangement according to the invention and known viscosity of the fluid, all other variables required for determining the volume flow, these being the throttle cross-section, the hydraulic key number of the arrangement according to the invention in case of this throttle cross-section and in case of the given viscosity of the fluid as well as the pressure difference between the first and the second side of the throttle cross-section, result with a good precision from the determined variables representing the throttle cross-section.

Embodiments combining the features of both of the above mentioned embodiments are particularly preferred. They can be used as combined switchable flow measurement entities and non-return valve entities. These functionalities are i.e. required for lift control valves and are provided today in complex ways by combining multiple individual arrangements.

In one preferred embodiment the arrangement is formed such that the second and third forces are substantially equal in case of identical fluid pressures in the first and in the second fluid chamber, this being reached in such a way that, in case of a direct force introduction without increase ratio or reduction ratio transmission mechanisms, the impact surfaces used for generating the corresponding force have the same dimensions. Thus, the operation behaviour of the arrangement is substantially identical, except for the opposite polarity of the pressure difference required for the actuation of the actuation element, in both switching states, meaning when the first and the third fluid chamber are connected via the switching arrangement as well as the second and the third fluid chamber are connected via the switching arrangement.

In one preferred embodiment the arrangement is formed such that in case of identical fluid pressures in the first, the second and the third fluid chamber the second, third and fourth force cancel out. This may be reached, in case of a direct force introduction without increase ratio or reduction ratio transmission mechanisms, by forming the impact surfaces in their sum used for generating the second and the third force with the same dimensions as the impact surface used for generating the fourth force. By this, a particularly fine response of the arrangement may be reached such that very small pressure differences between the first and the second side of the throttle cross-section lead to an opening or increasing respectively of the throttle cross-section.

If the actuation element has axial surfaces which are each fluid-connected with the first, the second and the third fluid chamber in order to generate the second, third and fourth force, this being preferred, a direct and lossless force introduction into the actuation element takes place.

Advantageously, the actuation element of the actuation arrangement and the throttle body of the throttle arrangement are formed by the same one-piece or multiple piece component. By this, a simple and compact assembly with a lossless coupling between the actuation element and the throttle body can be achieved.

One embodiment of the invention is related to a lift control valve with the arrangement according to the invention. The lift control valve has a first connecting port for an inlet line for hydraulic liquid coming from a hydraulic pump, a second connecting port for conducting hydraulic liquid back into a tank and a third connecting port for a hydraulic line leading to a hydraulic actuator of a lift installation. Furthermore, the lift control valve has a control arrangement by which the first side of the throttle cross-section as well as the first fluid chamber of the arrangement according to the invention are fluid-connectable optionally with the first connecting port or with the second connecting port, depending if the lift control valve shall be brought into a position in which, in case of correct operation, it shall enable the transmission of hydraulic liquid from the hydraulic pump to a hydraulic actuator of a lift installation (UPWARDS drive operation) or the back transmission of hydraulic liquid from a hydraulic actuator of a lift installation into a tank (DOWNWARDS drive operation). Furthermore, the lift control valve is formed such that the second side of the throttle cross-section and the second fluid chamber of the arrangement according to the invention are connected with the third connecting port or can be connected with it.

In this way, the arrangement according to one embodiment of the invention is integrated in the main line through which the hydraulic liquid flows, in case of correct UPWARDS drive operation or DOWNWARDS drive operation of the lift control valve in changing directions, and may take on, in case of a corresponding forming as mentioned above, i.e. tasks as switchable non-return valve and/or as switchable flow meter, this being preferred. It is particularly preferred that the arrangement according to one embodiment of the invention is formed, as mentioned at the beginning, such that it forms a combined flow meter and non-return valve entity that is switchable with respect to the flow direction. Thus it can accomplish both of the tasks mentioned above. By this, the effort in terms of installation technology can be substantially reduced as compared to present lift control valves with a same functionality and accordingly save costs for provision and maintenance.

The lift control valve is formed in a preferred embodiment such that, in case of correct operation, it comes inevitably to a connection of the second fluid chamber with the third fluid chamber by the switching arrangement during the connection of the first side of the throttle cross-section as well as the first fluid chamber with the first connecting port and in such a way that a connection of the first side of the throttle cross-section as well as the first fluid chamber with the second connecting port inevitably leads to a connection of the first fluid chamber with the third fluid chamber by the switching arrangement. By this, it is reached that the arrangement according to the invention is also switched during a switching of the control arrangement of the lift control valve from UPWARDS drive operation to DOWNWARDS drive operation and vice-versa and therefore is adjusted to the corresponding flow direction.

Advantageously, a continuously acting, preferably hydraulically actuated main valve, which is preferably executed in a piston slide way, is used as controller arrangement for making it possible to optionally connect the first side of the throttle cross-section either with the first or with the second connecting port of the lift control valve. Such controller arrangements are tested, operationally reliable and easy to maintain.

Further, for embodiments in case of which the controller arrangement of the lift control valve is a main valve, which can be actuated hydraulically. It is advantageous that the lift control valve has a valve by which the fluid supply for the hydraulic actuation of the main valve is fluid-connected with the second connecting port. Thus with the connecting port provided for conducting hydraulic liquid back into a tank when a certain pressure at the first connecting port is reached or surpassed respectively. By this it is possible to allow certain positions of the main valve and thereby certain operation states or operation state changes respectively of the lift control valve only when no noticeable fluid pressure is present at the connecting port for supplying hydraulic liquid from a hydraulic pump (first connecting port according to the claims), i.e. when the hydraulic pump connected there is switched off or the hydraulic liquid flow is closed.

Also it is preferred for embodiments in case of which the controller arrangement of the lift control valve has a main valve that can be actuated hydraulically that the lift control valve has a pilot valve that can be actuated electrically for the main valve that can be actuated hydraulically, by which the hydraulic actuator of the main valve can optionally be fluid-connected with the second side of the throttle cross-section or with the third connecting port or can be fluid-disconnected from the latter. In this way, when the lift control valve is used correctly, the fluid pressure generated by the gravitational force of a lift operated with it can be used for actuating the main valve in the line leading to the lift actuator, wherein this leads to the advantage that a controlled AB-trip is also possible in case of failure of the hydraulic pump.

It is thereby further preferred that the fluid-connection between the pilot valve and the hydraulic actuator of the main valve has a flow restriction leading to the second connecting port, meaning to the tank connecting port. This flow restriction advantageously has a throttle cross-section which can be changed depending on the valve position of the main valve. In case of a main valve executed as a piston valve it is preferred that the throttle cross-section is changeable depending on the position of the piston, this being preferably executed in such a way that the throttle cross-section is formed between the piston of the main valve and a fixed component. By this, a pressure relief of the connecting line between the pilot valve and the main valve is assured in case of a closed pilot valve. In case of embodiments with changeable throttle cross-section it is additionally possible to influence in a targeted way the response behaviour of the main valve.

In a further preferred embodiment the lift control valve is formed such that in case of hydraulic liquid being under pressure at the first connecting port no connection of the first side of the throttle cross-section of the throttle arrangement with the second connecting port is possible. By this it can be made sure that an AB-trip-operation of an installation formed with this lift control valve is only possible when the hydraulic pump is switched off or the hydraulic fluid flow is closed.

In one embodiment of the lift control valve, the switching arrangement of the arrangement according to the invention has a switching valve that can be actuated hydraulically, which can be switched during correct operation by opening or closing respectively a pressure release opening. The control arrangement of the lift control valve is formed in such a way that it opens the pressure release opening of the switching valve during the connection of the first side of the throttle cross-section of the throttle arrangement with the second connecting port (tank connecting port). By this, a coupling of the controller arrangement and switching arrangement is possible in a simple and operationally reliable way.

Generally it is preferred that the lift control valve is formed such that the actuation energy required for actuating its hydraulic actuatable valves can be taken from the hydraulic liquid used in operation of the lift control valve. In this manner it is possible to avoid further inlet and outlet lines for hydraulic liquid and the result is a lift control valve entity with a minimum of interfaces.

A third aspect of the invention is related to a hydraulic lift installation with a lift control valve according to the second aspect of the invention. The lift installation has a hydraulic pump, which is connected or which can be connected with the first connecting port of the lift control valve, a tank for hydraulic liquid which is connected or which can be connected with the second connecting port of the lift control valve and a hydraulic actuator which is connected or which can be connected with the third connecting port of the lift control valve by which a lift of the lift installation can be actuated. The hydraulic actuator is particularly formed as a linear actuator in the form of a hydraulic cylinder, it can however also be formed in another way, i.e. as a rotational hydraulic motor. The form of such a lift installation is an intended use of the lift control valve according to the second aspect of the invention.

In a preferred embodiment the lift installation has a control valve with an arrangement according to the invention with elements for determining the opening of the throttle cross-section of the throttle arrangement, the relative position of the actuation element and/or the relative position of the throttle body of the throttle arrangement. This embodiment of the lift installation further comprises a controller for the driving operation of the lift, which is connected and adapted to the previously mentioned elements such that in operation it can receive information from these elements about the opening of the throttle cross-section, the relative position of the actuation element and/or the relative position of the throttle body and is able to consider it during the controlling or regulation of the driving operation of a lift of the lift installation, preferably as a parameter representing the hydraulic liquid flow flowing through the throttle cross-section of the arrangement according to the invention, and particularly the driving speed of the lift associated thereto. By such hydraulic lift installations it is possible to achieve a very precise regulation of the driving speed of the lift with little technical effort.

A fourth aspect of the invention is related to a method for operating a lift installation according to the third aspect of the invention. The method comprises the following steps:

lifting a lift of the lift installation by conveying a volume of hydraulic liquid from the hydraulic pump to the hydraulic actuator of the lift, wherein the hydraulic liquid flows through the throttle cross-section of the throttle arrangement of the arrangement according to the invention from the first side of the throttle cross-section to the second side of the throttle cross-section and the second fluid chamber and the third fluid chamber of the arrangement are fluid-connected to each other via the switching arrangement and additionally to the second side of the throttle cross-section, whereas the first side of the throttle cross-section is fluid-connected with the first fluid chamber or lowering a lift of the lift installation by conveying a volume of hydraulic liquid from the hydraulic actuator of the lift to the tank, wherein the hydraulic liquid flows through the throttle cross-section of the arrangement according to the invention from the second side of the throttle cross-section to the first side of the throttle cross-section and the first fluid chamber and the third fluid chamber of the arrangement are fluid-connected to each other via the switching arrangement and additionally to the first side of the throttle cross-section, whereas the second side of the throttle cross-section is fluid-connected with the second fluid chamber;

determining the opening of the throttle cross-section of the throttle arrangement, the relative position of the actuation element of the actuation arrangement and/or the relative position of the throttle body of the throttle arrangement of the arrangement according to the invention during the conveying of the volume of hydraulic liquid through the throttle cross-section;

comparing the determined opening of the throttle cross-section, relative position of the actuation element, relative position of the throttle body of the throttle arrangement and/or a value calculated from one or more of these determined variables with a target value; and changing the volume of the hydraulic liquid conveyed through the throttle cross-section in case a deviation from the target value has been observed, such that the opening of the throttle cross-section, the relative position of the actuation element, the relative position of the throttle body and/or the calculated value converges with the target value.

It is preferred that the volume of hydraulic liquid conveyed through the throttle cross-section of the throttle arrangement is determined by an algorithm solely from the determined opening of the throttle cross-section, the determined relative position of the actuation element and/or the determined relative position of the throttle body of the throttle arrangement, optionally by additionally considering an also determined temperature value of the hydraulic liquid.

It is possible to regulate the lift installation according to the third aspect of the invention in UPWARDS drive operation and in DOWN-trip-operation in a precise way with respect to the driving speed of the lift without making it necessary to determine system pressures, such that a cost-efficient and particularly secure operation is possible.

In a preferred embodiment of the method the volume of hydraulic liquid conveyed during the lifting of the lift through the throttle cross-section of the throttle arrangement is changed in such a way that a higher or lower part of the volume conveyed by the hydraulic pump is redirected to the tank. In this way, the usage of cheap constant pumps is possible and the entire regulation is done via the lift control valve.

BRIEF DESCRIPTION OF THE DRAWINGS

Further embodiments, advantages and applications of the invention result from the dependent claims and from the now following description by means of the figures. Thereby it is shown in:

WAYS OF CARRYING OUT THE INVENTION

Figure 1:
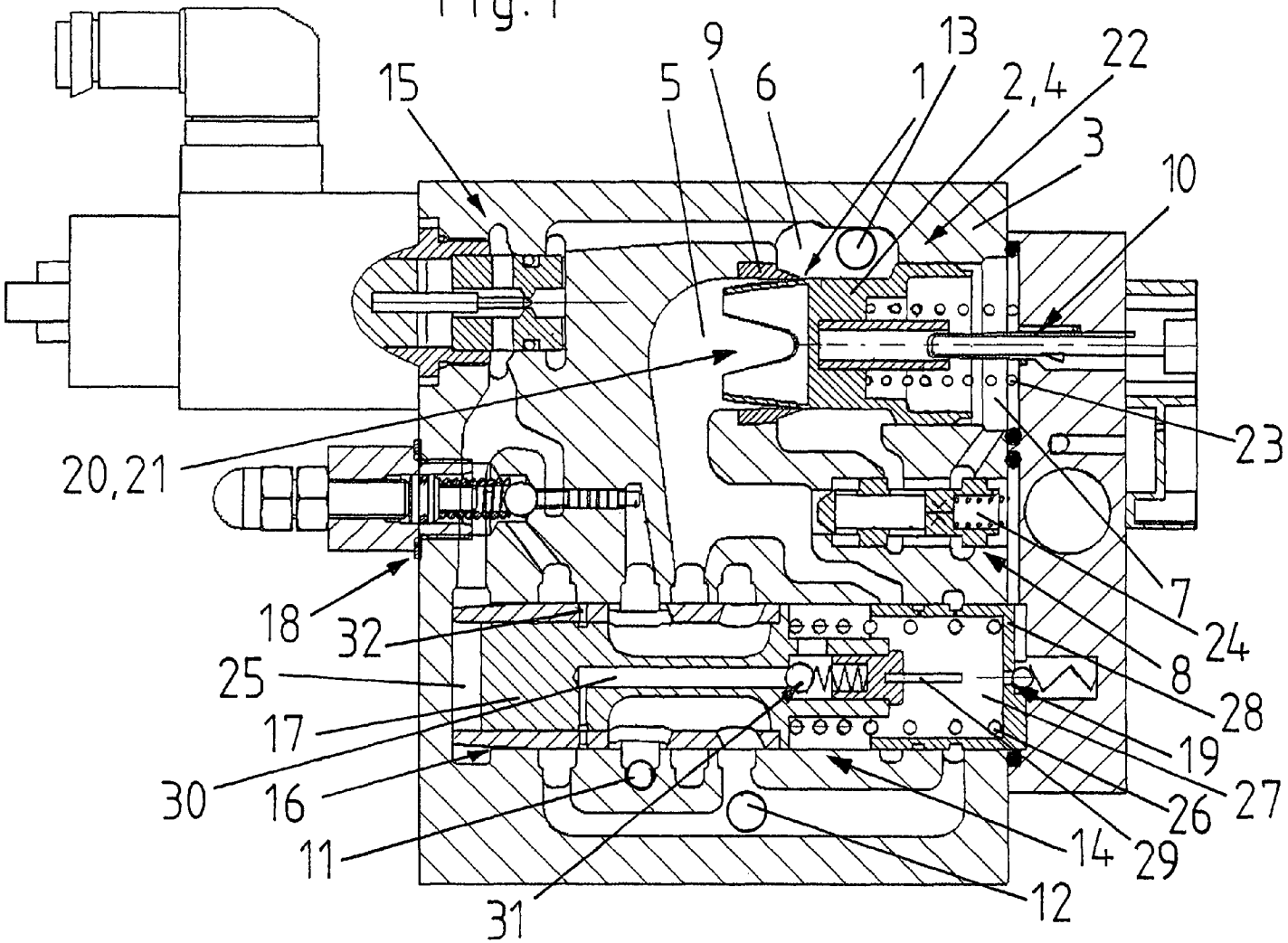
FIG. 1 is a section through a lift control valve according to one embodiment of the invention in a first operation situation.

FIG. 1 shows a section through a lift control valve according to one embodiment of the invention in a flow-free, idle state of the lift control valve. As can be seen, the lift control valve has a large metal casing 3, inside which a 3/4-way main valve 14 that can be actuated hydraulically, a pilot valve 15 for the main valve 14, a pressure limiting valve 18, an unlockable non-return valve 22 as well as a switching valve 8 for the non-return valve 22 are formed by inserting different functional entities from the outside. The non-return valve 22 forms together with the switching valve 8 an arrangement according to the invention for providing a variable throttle cross-section for a hydraulic liquid flow to be regulated by the lift control valve for a hydraulic lift actuator.

The main valve 14 is formed as a continuously acting spool valve, with a piston 17, which delimits at its left end a control oil chamber 25 and forms at this end together with a control edge of the casing 3 a flow restriction 16 that can be varied depending on the position of the piston. At its right end the piston 17 delimits a spring chamber 27 inside which a restoring spring 26 is arranged, which pushes the piston 17 to the left into a base position in case of a pressure-less control oil chamber 25. The spring chamber 27 is delimited for a part of its axial extension and at its end opposite with respect to the piston 17 by a restrictor sleeve 28 that depressurizes this chamber 27 via a flow restriction formed by itself towards the to second connecting port 12 (tank connecting port). Inside the piston 17 there is further arranged a central bore 30 with a non-return valve 31, via which oil can be conducted from a radial groove 32 at the periphery of the piston 17 into the spring chamber 27.

The pilot valve 15 for controlling the main valve 14 is formed as a continuously acting seat valve which forms a non-return valve in the direction of its intended flow direction in the shown flow-less state.

The main valve 14 and the corresponding pilot valve 15 form the controlling entity according to the invention of the lift control valve.

The unlockable non-return valve 22 is formed as a seat, with a throttle body 2 located inside the casing 3, which can be moved against the force of a spring 23 (the first force according to the claims), and a valve seat body 9 which is arranged in a fixed position within the casing 3. The throttle cross-section 1 formed between the throttle body 2 and the valve seat body 9 is fluid-closed in a base position when the throttle body 2 is not deflected and can be varied by deflecting the throttle body 2 from the base position depending on the position of the throttle body 2.

The throttle body 2 forms in the present case at the same time also the actuation element 4 according to the claims, by having axial surfaces which directly contact the first fluid chamber 5 according to the claims, a second fluid chamber 6 according to the claims and a third fluid chamber 7 according to the claims, such that as a result of fluid pressures in these fluid chambers 5, 6, 7 corresponding second, third, and fourth forces according to the claims can be exerted onto the throttle body 2 in and against the force direction of the spring 23. If the sum of these second, third and fourth forces exceeds the force of the spring 23 in opposite direction, the throttle body 2 is lifted from the valve seat body 9 and the throttle cross-section 1 is opened to until a balance between the spring force and the sum of the second, third and fourth force in a direction against the spring force is reached. In case of the present arrangement the ratios of the axial surfaces of the throttle body 2, 4 are chosen such that the second, third and fourth force cancel out in the presence of an identical fluid pressure in the first, second and third fluid chamber 5, 6, 7. As can be further seen, the throttle body 2 is coupled to a position sensor 10 at its right end, by means of which its position in the casing 3 can be determined as electric signals, in order to determine the volume flow of hydraulic fluid through the throttle cross-section 1 of the throttle valve 22 while in operation.

The switching valve 8 serving as a switching arrangement according to the claims, for switching the non-return valve 22, is formed as switching 3/2-way valve as a piston and is located, in the situation shown in FIG. 1, in a position in which it fluid-connects the second fluid chamber 6 and the third fluid chamber 7 and separates them from the first fluid chamber 5. By this, it is only possible to open the throttle cross-section 1 of the non-return valve 22 if a fluid pressure is generated inside the first fluid chamber 5 which exceeds the fluid pressure in the second 6 and in the third fluid chamber 7 and additionally is high enough to overcome the force of the spring 23 in the base position.

As can be seen, the piston of the switching valve 8 is loaded by a spring in such a way that it is held in the shown position in the absence of higher forces acting in the direction against the spring force. This spring is arranged inside a spring chamber 24 which is fluid-connected with the second 6 and third fluid chamber 7 by a flow restriction in the piston. Furthermore, the spring chamber 24 fluid-contacts the front face of the restrictor sleeve 28 of the main valve 14, at which a central pressure release opening 19 for depressurizing the spring chamber is located, being fluid-closed by a spring-loaded sphere in the operation situation shown in FIG. 1, such that the spring chamber 24 is not depressurized in this operation situation. The piston 17 of the main valve 14 has at its right end an actuation pin 29 by which in a position completely moved to the right it can open the pressure release opening 19 by removing the spring-loaded sphere from its seat and, by this, being able to fluid-connect the spring chamber 24 of the switching valve 8 with the spring chamber 27 of the main valve 14.

Figure 3:
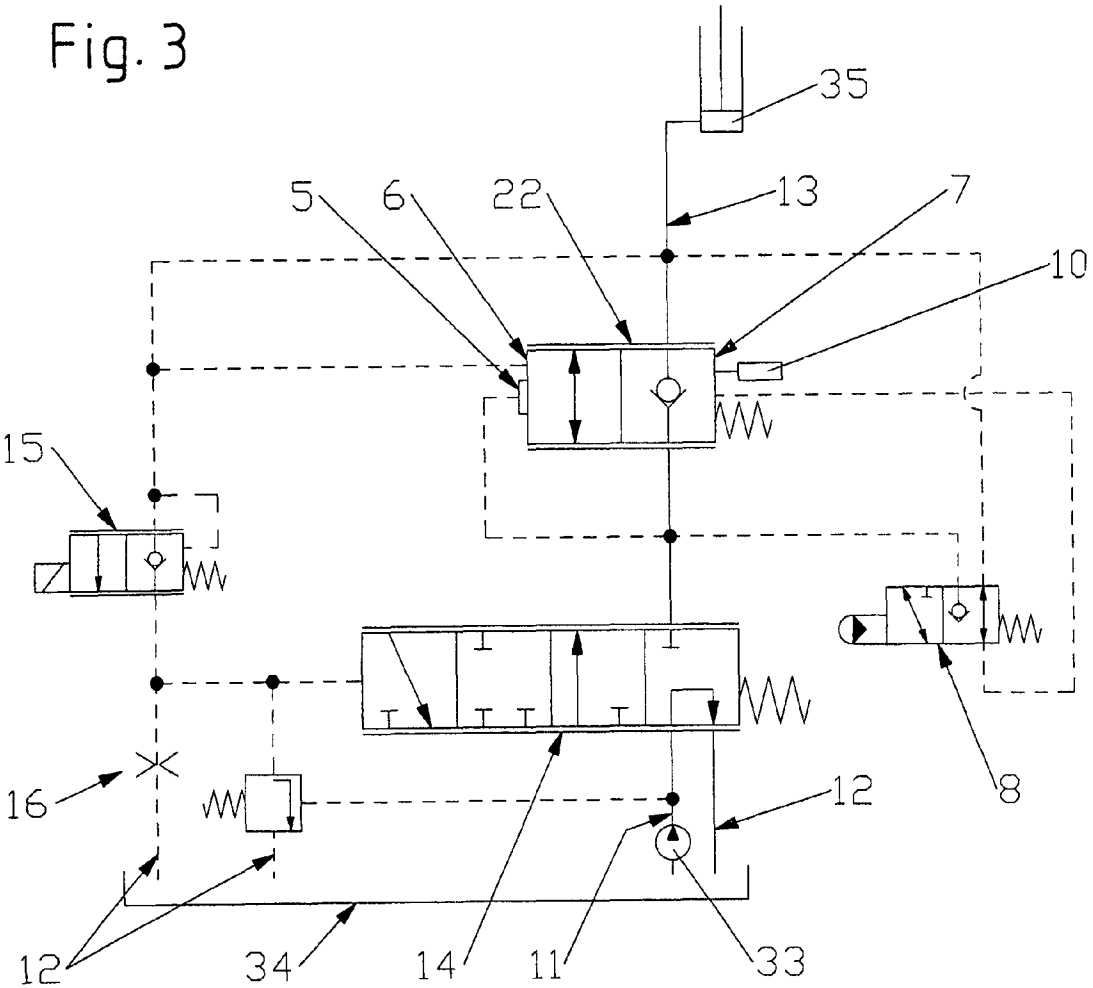
FIG. 3 is a hydraulic schematic of a lift installation with the lift control valve according to the preceding figures.

As can be further seen, particularly by considering FIG. 3, which shows the hydraulic schematic of a hydraulic lift installation formed with this lift control valve, the first fluid chamber 5 arranged on the first side according to the claims of the throttle cross-section 1 of the non-return valve 22 can be connected via the main valve 14 optionally with a first connecting port 11 for an inlet line for hydraulic liquid coming from a hydraulic pump 33 and with a second connecting port 12 for conducting hydraulic liquid back into a tank 34. The second fluid chamber 6, which is arranged on the second side according to the claims of the throttle cross-section 1 of the non-return valve 22, is permanently connected with a third connecting port 13 for a hydraulic line leading to a hydraulic actuator 35 of a lift installation and with the inlet side of the pilot valve 15. In the shown base position the throttle gap 1 is entirely closed such that the first 5 and the second fluid chamber 6 are mutually fluid-separated by it.

The pressure limiting valve 18 is located in the supply line for the control oil from the pilot valve 15 to the control oil chamber 25 of the main valve 14 and is formed such that when a certain fluid pressure at the first connecting port 11 is surpassed, this line is connected with the second connecting port 12 for the tank and by this the control oil pressure breaks down.

If now, as shown in FIG. 3 starting from the switching situation of the lift control valve shown in FIG. 1, the first connecting port 11 is fed with hydraulic oil by the hydraulic pump 33 and the second connecting port is connected with a hydraulic oil tank 34 out of which the hydraulic pump 33 pumps, the oil is conducted through the hollow main piston 17 of the main valve 14 to the second connecting port 12 and back to the tank 34, wherein a circulating pressure occurs inside the piston 17. This circulating pressure penetrates via gaps into the first fluid chamber 5. The fluid pressure in the second 6 and the third fluid chamber 7 is higher than the circulating pressure because of the hydraulic actuator 35 of a lift installation, onto which the weight of the lift rests and which is connected with the third connecting port 13, such that the throttle cross-section 1 of the valve 22 stays closed.

If now the pressure present at the third connecting port 13 or the second fluid chamber 6 is lead at least partly into the control oil chamber 25 of the main valve 14 and control the latter, by opening the pilot valve 15, the main piston 17 of the valve 14 is moved to the right, with the result that the outlet towards the tank is closed and the first connecting port 11 is connected with the first fluid chamber 5. At the same time, with an increasing deflection of the main piston 17, the throttle cross-section of the variable flow restriction 16 is increased, via which a part of the control oil flow for the main valve 14 to the second connecting port 12 and into the tank 34 is conducted. By this, the pilot valve 15 has to be opened disproportionately for an increasing deflection of the piston 17 of the main valve 14, such that a sensitive adjustability of the main valve 14 is the result.

As soon as the pressure in the first fluid chamber 5 has surpassed the fluid pressure in the second fluid chamber 6 and has additionally also neutralized the force of the spring 23, the throttle body 2 is deflected to the right. The throttle cross-section 1 opens and hydraulic oil flows under pressure from the first connecting port 11 to the third connecting port 13 and from there to the hydraulic lift actuator 35, in the present case a hydraulic cylinder acting unidirectional. This state corresponds to the UPWARDS drive operation of the lift control valve. The position of the throttle body 2 can be captured via the sensor 10 as electric position signal for an electronic control and is available in this way for a determination of the flow of hydraulic oil flowing through the throttle cross-section, without requiring a determination of pressure values for this.

In case of the UPWARDS drive operation the switching valve 8 stays in its position because the spring chamber 24 is in fluid-connection, at the right side of its piston which is not depressurized in this operation situation, with the second 6 and the third fluid chamber 7 via a flow restriction in the piston and its spring compensates for the little overpressure in the first fluid chamber 5 as compared to the pressures in the second 6 and the third fluid chamber 7 or in the spring chamber 24.

If the pilot valve 15 is again closed, the pressure in the control oil chamber 25 of the main valve 14 lowers via the flow restriction 16 and the piston 17 of the main valve 14 is pushed back again in the initial position shown in FIG. 1.

Figure 2:
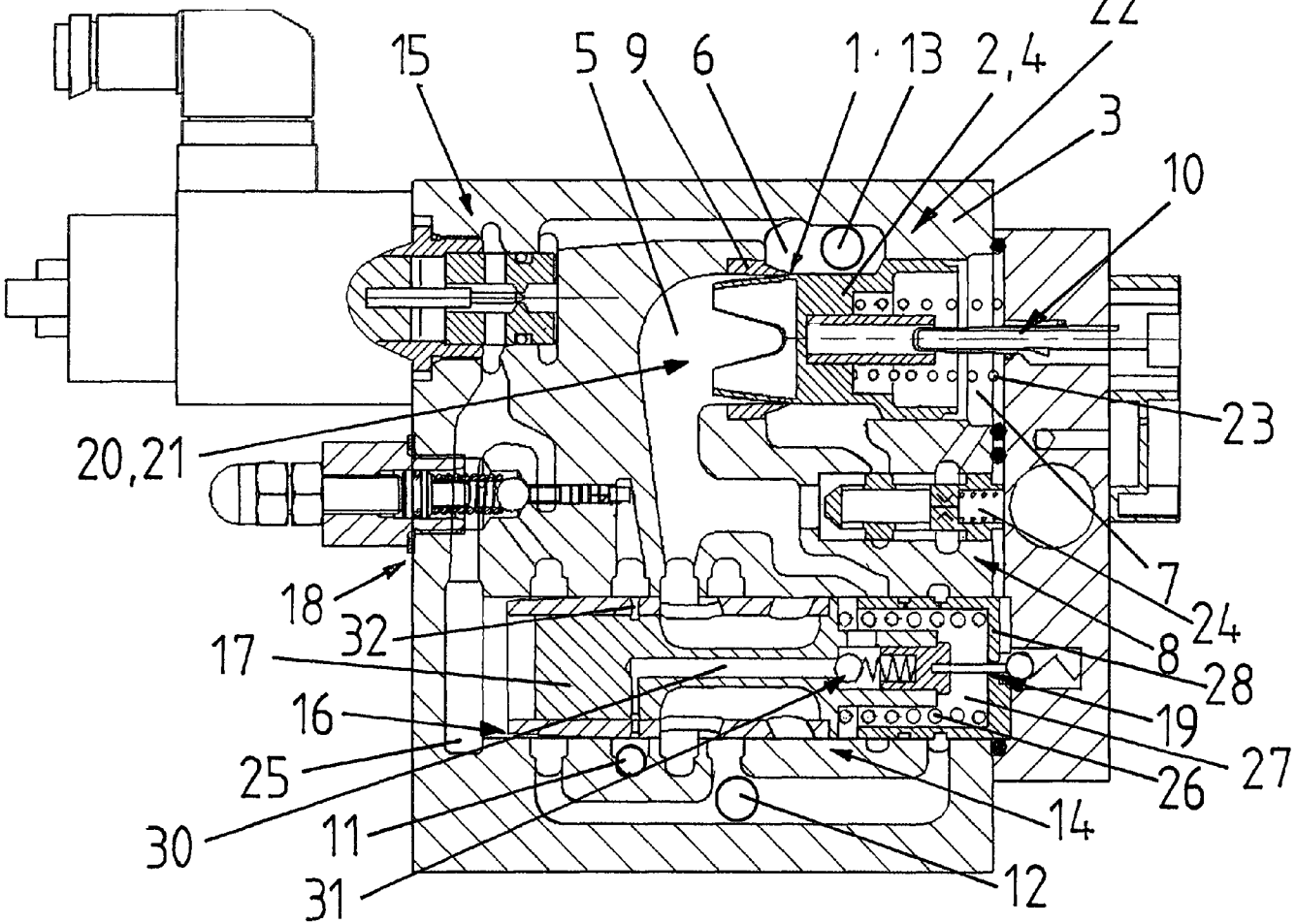
FIG. 2 a section through the lift control valve according to FIG. 1 in a second operation situation.

For a switching of the lift control valve in the situation shown in FIG. 2 which shows the lift control valve in the DOWNWARDS drive operation the piston 17 of the main valve 14 has to be brought into a position entirely deflected to the right, as can be seen.

This is however only possible if the first connecting port 11 is pressure-less, thus it is not connected with a running hydraulic pump 33, because otherwise, latest at a piston position in which the peripheral groove 32 comes to overlap the ring chamber following the first connecting port 11, the spring chamber 27 of the main valve 14 would be set under pressure and thereby a further deflection to the right of the piston 17 would be hydraulically avoided.

If the pilot valve 15 is entirely opened in case the first connecting port 11 is pressure-less and the third connecting port 13 is under pressure, the control oil pressure can move the piston 17 of the main valve 14 to the right up to the position shown in FIG. 2, wherein it lifts the spring-loaded sphere which fluid-closes the release opening 19 out of its seat by its actuation pin 29. By this, the first fluid chamber 5 is connected directly via the main valve 14 and the spring chamber 24 of the switching valve 8 indirectly via the release opening 19 and the restrictor sleeve 28 with the second connecting port 12 and the tank 34 and by this depressurized. As a result, the fluid pressure in the second fluid chamber 6 is sufficient, in connection with the axial surfaces of the piston of the switching valve 8, upon which it acts, to deflect this piston against the spring force to the right. Thereby, the pressure in the first fluid chamber 5, which acts upon the front face of the piston, increases after the lifting of the piston of the switching valve 8 out of its seat and helps additionally to deflect it entirely to the right into the shown position. Thereafter, the first fluid chamber 5 is connected with the third fluid chamber 7 and the second fluid chamber 6 is disconnected from them. By the connection of the third fluid chamber 7 with the first fluid chamber 5 the fluid pressure in the second fluid chamber 6, which only acts axially upon an annular surface of the throttle body 2, is sufficient, in connection with the fluid pressure in the first fluid chamber 5, which acts upon the front face of the throttle body 2, to move the throttle body 2 out of the base position to the right and to thereby open the throttle cross-section 1. Thereafter, the hydraulic liquid flows from the second fluid chamber 6 via the throttle cross-section 1 into the first fluid chamber 5 and from there via the main valve 14 and the second connecting port 12 into the tank 34. This state is equivalent to the DOWNWARDS drive operation of the lift control valve, wherein also in this case, as already in case of the above described UPWARDS drive operation, the position of the throttle body 2 can be captures via the sensor 10 as electric position signal for an electronic controller (not shown) and is so available for a determination of the volume flow of hydraulic oil now flowing in an opposite direction through the throttle cross-section 1, again without the need for a determination of system pressures.

If the pilot valve 15 is again closed, the pressure in the control oil chamber 25 of the main valve 14 decreases via the flow restriction 16 and the piston 17 of the main valve 14 is again pushed back by the spring 26 into the initial position shown in FIG. 1. Thereafter, the release opening 19 is again closed by the spring-loaded sphere and a fluid pressure builds up in the spring chamber 24 of the switching valve 8, this leading to a push of the piston of the switching valve 8 to the left and back into the position shown in FIG. 1, wherein it connects the second 6 and the third fluid chamber 7 with each other and disconnects the first fluid chamber 5 from it. This leads to an increase of the pressure in the spring chamber 7 of the non-return valve 22 and pushes the throttle body 2 to the left into the base position, in which it contacts impermeably to fluids the valve seat body 9 and has the lift control valve again entirely in the idle state shown in FIG. 1. In this state, in case of the lift installation shown in FIG. 3, the piston of the lift actuator 35 hydraulically rests on the non-return valve 22 the pilot valve 15 and the switching valve 8.

Although preferred embodiments of the invention are described in this application, it is clearly pointed out that the invention is not restricted to these and may also be executed in another way within the scope of the now following claims.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A lift control valve comprising:

an arrangement for a variable throttle cross-section for a fluid flow, comprising:

a casing;

a throttle arrangement having a throttle cross-section that is variable by a motion of a throttle body;

an actuation arrangement having an actuation element that is movable inside the casing and coupled to the throttle body of the throttle arrangement to vary the throttle cross-section depending on a relative position of the actuation element inside the casing;

a first spring force that permanently acts on the actuation element in a first direction and positions the actuation element in a base position in the casing in the absence of at least equal forces acting upon the actuation element in a second direction which is opposite the first direction;

a first fluid chamber of the arrangement, which is one of fluid-connected and fluid-connectable to a first side of the throttle cross-section, wherein as a result of a first fluid pressure in the first fluid chamber the actuation element is acted upon with a second force acting in the second direction;

a second fluid chamber of the arrangement, which is one of fluid-connected and fluid-connectable to the second side of the throttle cross-section, wherein as a result of a second fluid pressure in the second fluid chamber the actuation element is acted upon with a third force acting in the second direction;

a third fluid chamber of the arrangement, wherein as a result of a third fluid pressure in the third fluid chamber, the actuation element is acted upon with a fourth force acting in the first direction, wherein, if no further forces act upon the actuation element in the first or the second direction and the sum of the second, the third, and the fourth forces is a resulting force that acts in the second direction and which is higher than the first spring force acting upon the actuation element in the base position in the first direction, the actuation element is moved away from the base position until a balance of forces between the first spring force acting upon the actuation element in its corresponding relative position and at least one of the resulting force is reached and a maximum motion position is reached; and a switching arrangement by which one of:

the first fluid chamber and the third fluid chamber are fluid-connected and the second fluid chamber and the third fluid chamber are fluid-connected;

a first connecting port for an inlet line for hydraulic liquid coming from a hydraulic pump;

a second connecting port for conducting hydraulic liquid back into a tank;

a third connecting port for a hydraulic line leading to a hydraulic actuator of a lift installation;

a control arrangement configured such that the first fluid chamber and the first side of the throttle cross-section are fluid-connectable with one of the first connecting port and the second connecting port, wherein the second fluid chamber and the second side of the throttle cross-section is one of connected or connectable with the third connecting port, wherein the lift control valve is formed in such a way that:

an automatic connection of the second fluid chamber with the third fluid chamber occurs by the switching arrangement during a connection of the first fluid chamber and the first side of the throttle cross-section with the first connecting port, and an automatic connection of the first fluid chamber with the third fluid chamber takes place by the switching arrangement during a connection of the first fluid chamber and the first side of the throttle cross-section with the second connecting port, wherein a valve connects the supply of fluid to the hydraulic actuator of the main valve to the second connecting port when a certain pressure is reached at the first connecting port.

2. The arrangement for a variable throttle cross-section for a fluid flow according to claim 1, wherein the throttle cross-section of the throttle arrangement is entirely closed when the actuation element is arranged in the base position.

3. The arrangement for a variable throttle cross-section for a fluid flow according to claim 1, further comprising at least one sensor configured to determine at least one of an opening of the throttle cross-section of the throttle arrangement, the relative position of the actuation element in the casing, and the relative position of the throttle body of the throttle arrangement, wherein relative positions of at least one of the actuation element and of the throttle body is converted in electric signals.

4. The arrangement for a variable throttle cross-section for a fluid flow according to claim 1, wherein the throttle arrangement is a seat valve.

5. The arrangement for a variable throttle cross-section for a fluid flow according to claim 1, wherein the actuation element of the actuation arrangement and the throttle body of the throttle arrangement are formed by a common component.

6. The lift control valve according to claim 1, wherein the control arrangement has a continuously acting hydraulically actuated main valve executed in a piston slide way configured to connect the first side of the throttle cross-section with one of the first connecting port and the second connecting port.

7. The lift control valve according to claim 1, wherein the control arrangement is formed such that in case of hydraulic liquid being under pressure at the first connecting port no connection of at least one of the first side of the throttle cross-section of the throttle arrangement and of the first fluid chamber with the second connecting port is possible.

8. The lift control valve according to claim 1, wherein the switching arrangement has a hydraulically actuated switching valve, which can be switched during correct operation by opening or closing respectively a pressure release opening and wherein the control arrangement is formed such that it opens the pressure release opening of the switching valve during the connection of at least one of the first side of the throttle cross-section of the throttle arrangement and of the first fluid chamber with the second connecting port.

9. The lift control valve according to claim 8, wherein the lift control valve is formed such that an actuation energy required for actuating its hydraulic actuatable valves can be taken from the hydraulic liquid used in operation of the lift control valve.

10. A lift control valve comprising:

comprising:

an arrangement for a variable throttle cross-section for a fluid flow, comprising:

a casing;

a throttle arrangement having a throttle cross-section that is variable by a motion of a throttle body;

an actuation arrangement having an actuation element that is movable inside the casing and coupled to the throttle body of the throttle arrangement to vary the throttle cross-section depending on a relative position of the actuation element inside the casing;

a first spring force that permanently acts on the actuation element in a first direction and positions the actuation element in a base position in the casing in the absence of at least equal forces acting upon the actuation element in a second direction which is opposite the first direction;

a first fluid chamber of the arrangement, which is one of fluid-connected and fluid-connectable to a first side of the throttle cross-section, wherein as a result of a first fluid pressure in the first fluid chamber the actuation element is acted upon with a second force acting in the second direction;

a second fluid chamber of the arrangement, which is one of fluid-connected and fluid-connectable to the second side of the throttle cross-section, wherein as a result of a second fluid pressure in the second fluid chamber the actuation element is acted upon with a third force acting in the second direction;

a third fluid chamber of the arrangement, wherein as a result of a third fluid pressure in the third fluid chamber, the actuation element is acted upon with a fourth force acting in the first direction, wherein, if no further forces act upon the actuation element in the first or the second direction and the sum of the second, the third, and the fourth forces is a resulting force that acts in the second direction and which is higher than the first spring force acting upon the actuation element in the base position in the first direction, the actuation element is moved away from the base position until a balance of forces between the first spring force acting upon the actuation element in its corresponding relative position and at least one of the resulting force is reached and a maximum motion position is reached; and a switching arrangement by which one of:

the first fluid chamber and the third fluid chamber are fluid-connected and the second fluid chamber and the third fluid chamber are fluid-connected;

a first connecting port for an inlet line for hydraulic liquid coming from a hydraulic pump;

a second connecting port for conducting hydraulic liquid back into a tank;

a third connecting port for a hydraulic line leading to a hydraulic actuator of a lift installation;

a control arrangement configured such that the first fluid chamber and the first side of the throttle cross-section are fluid-connectable with one of the first connecting port and the second connecting port, wherein the second fluid chamber and the second side of the throttle cross-section is one of connected or connectable with the third connecting port, wherein the lift control valve is formed in such a way that:

an automatic connection of the second fluid chamber with the third fluid chamber occurs by the switching arrangement during a connection of the first fluid chamber and the first side of the throttle cross-section with the first connecting port, and an automatic connection of the first fluid chamber with the third fluid chamber takes place by the switching arrangement during a connection of the first fluid chamber and the first side of the throttle cross-section with the second connecting port, wherein the lift control valve comprises an electrically actuated pilot valve for the main valve, which can be actuated hydraulically, by which the hydraulic actuator of the main valve is fluid-connected with at least one of:

the second side of the throttle cross-section and the second fluid chamber, and can be fluid-disconnected from the second fluid chamber to actuate the main valve.

11. The lift control valve according to claim 10, wherein the fluid connection between the pilot valve and the hydraulic actuator of the main valve has a flow restriction leading to the second connecting port.

12. The lift control valve according to claim 11, wherein the flow restriction has a throttle cross-section which is changeable depending on the valve position of the main valve, configured as a piston valve, the valve position depending on a position of the piston of the main valve.

13. A hydraulic lift installation comprising:

an arrangement for a variable throttle cross-section for a fluid flow, comprising:

a casing;

a throttle arrangement having a throttle cross-section that is variable by a motion of a throttle body;

an actuation arrangement having an actuation element that is movable inside the casing and coupled to the throttle body of the throttle arrangement to vary the throttle cross-section depending on a relative position of the actuation element inside the casing;

a first spring force that permanently acts on the actuation element in a first direction and positions the actuation element in a base position in the casing in the absence of at least equal forces acting upon the actuation element in a second direction which is opposite the first direction;

a first fluid chamber of the arrangement, which is one of fluid-connected and fluid-connectable to a first side of the throttle cross-section, wherein as a result of a first fluid pressure in the first fluid chamber the actuation element is acted upon with a second force acting in the second direction;

a second fluid chamber of the arrangement, which is one of fluid-connected and fluid-connectable to the second side of the throttle cross-section, wherein as a result of a second fluid pressure in the second fluid chamber the actuation element is acted upon with a third force acting in the second direction;

a third fluid chamber of the arrangement, wherein as a result of a third fluid pressure in the third fluid chamber, the actuation element is acted upon with a fourth force acting in the first direction, wherein, if no further forces act upon the actuation element in the first or the second direction and the sum of the second, the third, and the fourth forces is a resulting force that acts in the second direction and which is higher than the first spring force acting upon the actuation element in the base position in the first direction, the actuation element is moved away from the base position until a balance of forces between the first spring force acting upon the actuation element in its corresponding relative position and at least one of the resulting force is reached and a maximum motion position is reached; and a switching arrangement by which one of:

the first fluid chamber and the third fluid chamber are fluid-connected and the second fluid chamber and the third fluid chamber are fluid-connected;

a first connecting port for an inlet line for hydraulic liquid coming from a hydraulic pump;

a second connecting port for conducting hydraulic liquid back into a tank;

a third connecting port for a hydraulic line leading to a hydraulic actuator of a lift installation;

a control arrangement configured such that the first fluid chamber and the first side of the throttle cross-section are fluid-connectable with one of the first connecting port and the second connecting port, wherein the second fluid chamber and the second side of the throttle cross-section is one of connected or connectable with the third connecting port;

a hydraulic pump which is connected to the first connecting port of the lift control valve;

a tank which is connected with the second connecting port of the lift control valve; and a hydraulic actuator configured as a hydraulic cylinder connected with the third connecting port of the lift control valve by which the lift installation can be actuated, wherein the lift control valve comprises:

a sensor for determining at least one of the opening of the throttle cross-section of the throttle arrangement, the relative position of the actuation element, and the relative position of the throttle body of the throttle arrangement; and a controller for the driving operation of the lift, which is connected and adapted such that in operation it can receive information from the sensors about at least one of the opening of the throttle cross-section, the relative position of the actuation element, and the relative position of the throttle body and consider it during the controlling or regulation respectively of the driving operation of a lift of the lift installation as a parameter representing the hydraulic liquid flow flowing through the throttle cross-section of the throttle arrangement and the driving speed of the lift associated thereto.

14. A method for operating a lift installation, comprising:

an arrangement for a variable throttle cross-section for a fluid flow, comprising:

a casing;

a throttle arrangement having a throttle cross-section that is variable by a motion of a throttle body;

an actuation arrangement having an actuation element that is movable inside the casing and coupled to the throttle body of the throttle arrangement to vary the throttle cross-section depending on a relative position of the actuation element inside the casing;

a first spring force that permanently acts on the actuation element in a first direction and positions the actuation element in a base position in the casing in the absence of at least equal forces acting upon the actuation element in a second direction which is opposite the first direction;

a first fluid chamber of the arrangement, which is one of fluid-connected and fluid-connectable to a first side of the throttle cross-section, wherein as a result of a first fluid pressure in the first fluid chamber the actuation element is acted upon with a second force acting in the second direction;

a second fluid chamber of the arrangement, which is one of fluid-connected and fluid-connectable to the second side of the throttle cross-section, wherein as a result of a second fluid pressure in the second fluid chamber the actuation element is acted upon with a third force acting in the second direction;

a third fluid chamber of the arrangement, wherein as a result of a third fluid pressure in the third fluid chamber, the actuation element is acted upon with a fourth force acting in the first direction, wherein, if no further forces act upon the actuation element in the first or the second direction and the sum of the second, the third, and the fourth forces is a resulting force that acts in the second direction and which is higher than the first spring force acting upon the actuation element in the base position in the first direction, the actuation element is moved away from the base position until a balance of forces between the first spring force acting upon the actuation element in its corresponding relative position and at least one of the resulting force is reached and a maximum motion position is reached; and a switching arrangement by which one of:

the first fluid chamber and the third fluid chamber are fluid-connected and the second fluid chamber and the third fluid chamber are fluid-connected;

a first connecting port for an inlet line for hydraulic liquid coming from a hydraulic pump;

a second connecting port for conducting hydraulic liquid back into a tank;

a third connecting port for a hydraulic line leading to a hydraulic actuator of a lift installation;

a control arrangement configured such that the first fluid chamber and the first side of the throttle cross-section are fluid-connectable with one of the first connecting port and the second connecting port, wherein the second fluid chamber and the second side of the throttle cross-section is one of connected or connectable with the third connecting port;

a hydraulic pump which is connected to the first connecting port of the lift control valve;

a tank which is connected with the second connecting port of the lift control valve; and a hydraulic actuator configured as a hydraulic cylinder connected with the third connecting port of the lift control valve by which the lift installation can be actuated, the method comprising:

one of:

lifting a lift of the lift installation by conveying a volume of the hydraulic liquid from the hydraulic pump to the hydraulic actuator of the lift, wherein the hydraulic liquid flows through the throttle cross-section of the throttle arrangement from the first side of the throttle cross-section to the second side of the throttle cross-section and the second fluid chamber and the third fluid chamber are fluid-connected to each other and to the second side of the throttle cross-section whereas the first side of the throttle cross-section is fluid-connected with the first fluid chamber, and lowering a lift of the lift installation by conveying a volume of hydraulic liquid from the hydraulic actuator of the lift into the tank, wherein the hydraulic liquid flows through the throttle cross-section of the throttle arrangement from the second side of the throttle cross-section to the first side of the throttle cross-section and the first fluid chamber and the third fluid chamber are fluid-connected to each other and to the first side of the throttle cross-section whereas the second side of the throttle cross-section is fluid-connected with the second fluid chamber;

determining at least one of the opening of the throttle cross-section of the throttle arrangement, the relative position of the actuation element of the actuation arrangement, and the relative position of the throttle body of the throttle arrangement during the conveying of the volume of hydraulic liquid through the throttle cross-section;

comparing at least one of the determined opening of the throttle cross-section, the determined relative position of the actuation element, the determined relative position of the throttle body of the throttle arrangement and a value calculated from one or more of these determined variables with a target value; and changing the volume of the hydraulic liquid conveyed through the throttle cross-section, in case a deviation from the target value has been observed, such that at least one of the opening of the throttle cross-section, the relative position of the actuation element, the relative position of the throttle body, and the calculated value converges with the target value.

15. The method according to claim 14, wherein during the lifting of the lift the volume of hydraulic liquid conveyed through the throttle cross-section of the throttle arrangement is changed such that one of a higher or lower part of the volume conveyed by the hydraulic pump is redirected to the tank by the controlling entity of the lift control valve.

16. The method according to claim 15, wherein the volume of hydraulic liquid conveyed through the throttle cross-section is determined by an algorithm solely from at least one of the determined opening of the throttle cross-section, the determined relative position of the actuation element, and the determined relative position of the throttle body of the throttle arrangement and a determined temperature value of the hydraulic liquid.

* * * * *